US010314127B2

(12) United States Patent
Zheng

(10) Patent No.: US 10,314,127 B2
(45) Date of Patent: Jun. 4, 2019

(54) PARALLEL-TYPE LIGHT STRING

(71) Applicant: Dian Qing Zheng, Guangzhou (CN)

(72) Inventor: Dian Qing Zheng, Guangzhou (CN)

( * ) Notice: Subject to any disclaimer, the term of this patent is extended or adjusted under 35 U.S.C. 154(b) by 0 days.

(21) Appl. No.: 15/822,003

(22) Filed: Nov. 24, 2017

(65) Prior Publication Data

US 2019/0104588 A1 Apr. 4, 2019

(30) Foreign Application Priority Data

Sep. 29, 2017 (CN) ..... 2017 1 0904163

(51) Int. Cl.
*H05B 33/08* (2006.01)

(52) U.S. Cl.
CPC ..... *H05B 33/0845* (2013.01); *H05B 33/0857* (2013.01)

(58) Field of Classification Search
CPC .... H05B 37/02; H05B 37/032; H05B 37/034; H05B 33/06; H05B 33/08; H05B 33/0806; H05B 33/0812; H05B 33/0827; H05B 41/16; F21S 4/00; F21S 4/10; F21V 23/00; F21V 23/001
USPC ..... 315/185 S
See application file for complete search history.

(56) References Cited

U.S. PATENT DOCUMENTS 6,285,140 B1 * 9/2001 Ruxton ..... H05B 33/0803 315/291
2006/0198143 A1 * 9/2006 Cheung ..... F21V 23/0407 362/249.12
2008/0310183 A1 * 12/2008 Fan ..... F21K 9/00 362/555
2009/0302771 A1 * 12/2009 Peng ..... H05B 33/0803 315/193
2012/0086349 A1 * 4/2012 Segan ..... H05B 33/0803 315/187
2012/0326634 A1 * 12/2012 Li ..... H05B 33/0803 315/312
2017/0141516 A1 * 5/2017 Chen ..... H01R 4/185

FOREIGN PATENT DOCUMENTS

CN 203206544 U * 9/2013

* cited by examiner

*Primary Examiner* — Tung X Le
*Assistant Examiner* — Henry Luong
(74) *Attorney, Agent, or Firm* — Hemisphere Law, PLLC; Zhigang Ma

(57) ABSTRACT

A parallel-type LED light string includes LED units connected in parallel to form a light string, the LED units are electrically connected to a first and a second conductive wires, one ends of the first conductive wire and the second conductive wire are respectively connected to a first end of the first one LED unit and a second end of the last one LED unit. The efficacy is that: voltages and currents of respective LED units of the entire light string are consistent and thus uniform brightness is achieved, and the number of 1-N LED units can be determined according to power of a power supply. Such parallel-type LED light string is better than a serial-type LED light string in that one abnormal LED unit does not affect other LED units, production process is simple, production cost is low and it is more suitable for decorative LED light string.

4 Claims, 2 Drawing Sheets

PARALLEL-TYPE LIGHT STRING

FIELD OF THE DISCLOSURE

The disclosure particularly relates to a new parallel-type light string.

BACKGROUND

As to a traditional parallel-type LED light string, positive and negative electrodes of a power supply both are connected to the first LED unit of the light string, because of the problem of voltage drop, the LED unit at the front of the light string and near power supply wires are relatively bright, the more backward in position of the LED unit, the darker the LED unit is, and when the number of the LED unit is more than 30, the brightnesses at the front and at the rear of the light string will be very different. If a supply voltage is attempted to be increased for the purpose of solving the problem of voltage drop, the LED unit at the most front of the light string will be burned out soon.

In another aspect, a "DCTD-protocol based LED" is also called as a "LED equipped with IC chip" and may be a monochromatic LED equipped with IC chip, a RGB LED equipped with IC chip or a W+RGB LED equipped with IC chip.

SUMMARY

An objective of the disclosure is to provide a new parallel-type LED light string with simple production process, uniform brightness and independently workable LED units, so as to solve the problem in the prior art.

In order to achieve the objective, the disclosure provides the following technical solutions.

I In particular, a new parallel-type LED light string includes multiple LED units connected in parallel to form a light string; the LED units are electrically connected to a first conductive wire and a second conductive wire, each of the LED units includes a first end and a second end, one end of the first conductive wire is connected to the first end of a first one of the LED units, and one end of the second conductive wire is connected to the second end of a last one of the LED units.

In an embodiment, each of the LED units includes one forward LED and one backward LED connected in parallel, and the other ends of the first conductive wire and the second conductive wire are connected to a light string controller.

In an embodiment, the light string includes DCTD-protocol based LEDs, the LED units and the DCTD-protocol based LEDs are alternately disposed and connected in parallel in the light string; and the other ends of the first conductive wire and the second conductive wire are connected to a DCTD-protocol based controller.

In an embodiment, the light string is a linear light string, a circular light string, or a semicircular light string.

The efficacy of the disclosure are that:

in one aspect, as to the LED equipped with IC chip: a DCTD-protocol based controller with a DCTD (DC Wire Transmit Data) protocol configured therein superimposes transmission slot pulse signals and delivers them to LEDs with respective decoding ICs through two power supply wires and thereby controls the changes of light colors and patterns of the LEDs while without affecting other common LED units, so that functions and patterns of the light string become more while only two wires are required; as a result, compared with other way of achieving the same function and effect, it requires less material as well as less manpower;

in another aspect, multiple LED units are connected in parallel to form the light string and a wire connection mode is that: the first conductive wire and the second conductive wire are respectively connected to the first one LED unit and the last one LED unit, so that voltages and currents of the respective LED units of the entire light string are consistent and thus uniform brightness is achieved, and moreover the number of 1-N LED units can be determined according to power of a power supply; and in still another aspect, for such parallel-type LED light string, it is better than a serial-type LED light string (when the number of serially-connected LED units in the serial-type LED light string is more than 50, the light units respectively at the front and at the rear will have a more significant difference in brightness, and when one LED unit in a group is abnormal, the whole group does not light up), and in particular one abnormal LED unit in the parallel-type light string would not affect the other LED units, the production process is simple, the production cost is low and it is more suitable for decorative LED light string.

DETAILED DESCRIPTION OF EMBODIMENTS

In the following, technical solutions in embodiment of the disclosure will be described clearly and completely in accordance with the drawings in the embodiments of the disclosure.

Figure 1:
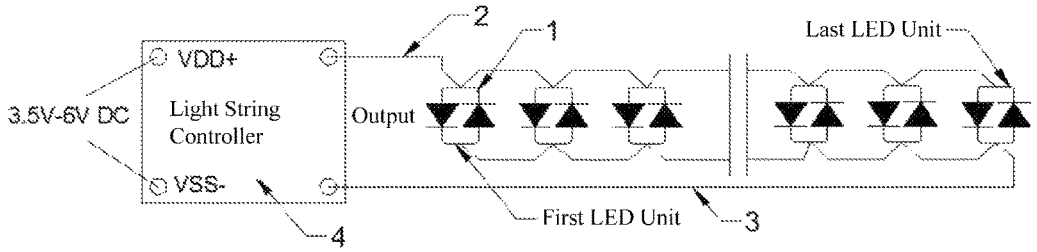
FIG. 1 is a schematic view of a first embodiment of a new parallel-type light string.

Please referring to FIG. 1, in a first embodiment of the disclosure, a new parallel-type light string includes multiple (i.e., more than one) LED units 1 connected in parallel to form a light string. The LED units 1 are electrically connected to a first conductive wire 2 and a second conductive wire 3. Each of the LED units 1 includes a first end and a second end. One end of the first conductive wire 2 is connected to the first end of the first one of the LED units 1, and one end of the second conductive wire 3 is connected to the second end of the last one of the LED units 1. Each of LED units 1 includes two individual light emitting diodes i.e., a forward LED and a backward LED, connected in parallel (between the first end and the second end). The other ends of the first conductive wire 2 and the second conductive wire 3 are connected to a light string controller 4. The light string controller 4 may control DC positive electrode and negative electrode to repeatedly alternate, so that displays and flickers of the LED units are diversified.

Figure 2:
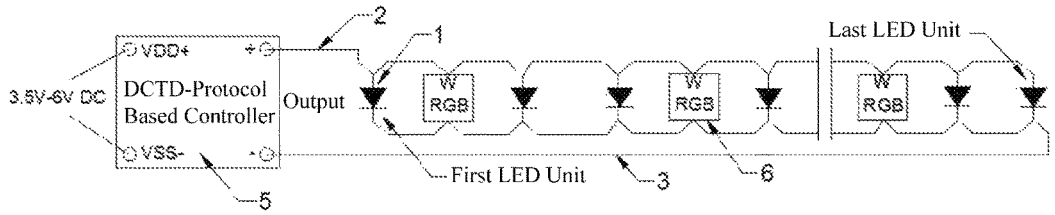
FIG. 2 is a schematic view of a second embodiment of a new parallel-type light string.

Please referring to FIG. 2, in a second embodiment of the disclosure, a difference from the first embodiment is that: the light string includes DCTD-protocol based LEDs 6, the LED units 1 and the DCTD-protocol based LEDs 6 are alternately disposed and connected in parallel in the light string, and the other ends of the first conductive wire 2 and the second conductive wire 3 are connected to a DCTD-protocol based controller 5. The DCTD-protocol based controller 5 only controls the DCTD-protocol based LEDs 6.

Figure 3:
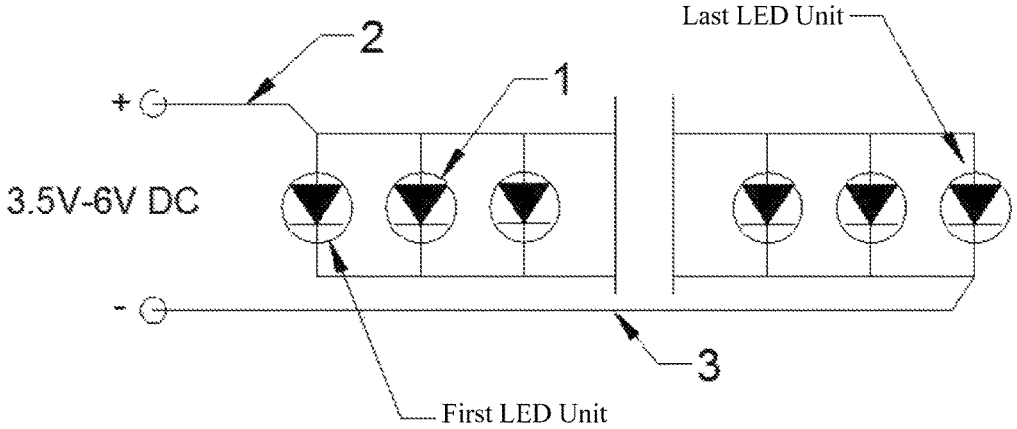
FIG. 3 is a schematic view of a third embodiment of a new parallel-type light string.

Please referring to FIG. 3, in a third embodiment of the disclosure, a difference from the first embodiment is that: the LED units 1 each are a single light emitting diode, the first conductive wire 2 and second conductive wire 3 are directly connected to a direct current (DC) power supply. The first conductive wire 2 is connected to a positive electrode of the direct current power supply, and the second conductive wire 3 is connected to a negative electrode of the direct current power supply.

Figure 4:
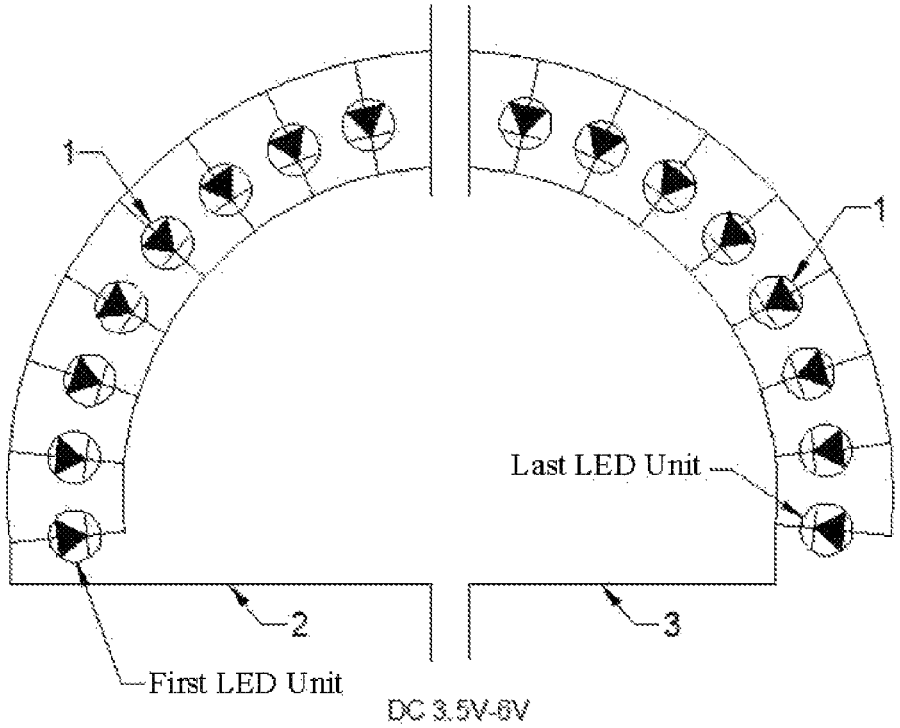
FIG. 4 is a schematic view of a shape of a new parallel-type light string.

In the above embodiments, the light string may be arranged into a variety of shapes such as: a linear light string, a circular light string, a semicircular light string (as show in FIG. 4) and so on.

For one skilled in the art, apparently, the disclosure is not limited to the details of the foregoing exemplary embodiments, under the prerequisite of without departing from the spirit or essential characteristics of the disclosure, other specific forms may be used to achieve the disclosure. Therefore, no matter from what point of view, the described embodiments should be considered as illustrative and not restrictive, the scope of the disclosure is defined by the appended claims rather than by the foregoing description and thus is intended to encompass meanings of equivalent elements within the claims and all changes within the scope of the claims. Any reference numerals of accompanying drawings involved in the claims should not be construed as limiting the related claims.

In addition, it should be understood that although the specification is described in terms of the embodiments, not every embodiment includes only one independent technical solution. This description of the specification is merely for the sake of clarity and one person skilled in the art should take the specification as a whole. The technical solutions of the respective described embodiments can also be appropriately combined to form other embodiments that can be understood by one skilled in the art.

What is claimed is:

1. A parallel-type LED light string, comprising a plurality of LED units connected in parallel to form a light string; wherein said plurality of LED units are electrically connected in parallel between a first conductive wire and a second conductive wire, each of said plurality of LED units comprises a first end and a second end, one end of said first conductive wire is connected to the first end of a first one of said plurality of LED units, one end of said second conductive wire is connected to the second end of a last one of said plurality of LED units, another ends of said first conductive wire and said second conductive wire are connected to a controller;

wherein said light string further comprises DCTD (DC wire transmit data)protocol based LEDs, said plurality of LED units and said DCTD protocol based LEDs are alternately disposed and connected in parallel between said first conductive wire and said second conductive wire, said controller comprises a DCTD protocol based controller with a DCTD protocol configured therein; said first conductive wire and said second conductive wire respectively are two power supply wires, and said DCTD protocol based controller is configured to superimpose transmission slot pulse signals and deliver the transmission slot pulse signals to said DCTD protocol based LEDs through the two power supply wires; said DCTD protocol based controller further is configured for only controlling said DCTD protocol based LEDs while without affecting said plurality of LED units; and each of said DCTD protocol based LEDs is an RGB LED equipped with IC chip.

2. The parallel-type LED light string as claimed in claim 1, wherein said light string is a linear light string.

3. The parallel-type LED light string as claimed in claim 1, wherein said light string is a circular light string.

4. The parallel-type LED light string as claimed in claim 1, wherein said light string is a semicircular light string.

* * * * *